United States Patent [19]

Stobb

[11] 4,451,967

[45] Jun. 5, 1984

[54] CRANE SYSTEM SHEET FEEDER METHOD AND APPARATUS

[75] Inventor: Walter J. Stobb, Pittstown, N.J.

[73] Assignee: Stobb, Inc., Clinton, N.J.

[21] Appl. No.: 368,372

[22] Filed: Apr. 14, 1982

[51] Int. Cl.[3] ..... B23Q 7/00

[52] U.S. Cl. ..... 29/564.3; 83/417; 83/909; 414/273; 414/564; 414/907

[58] Field of Search ..... 198/358; 414/751, 564, 414/273; 83/909, 417, 280; 29/564.3

[56] References Cited

U.S. PATENT DOCUMENTS

| | | | |
|---|---|---|---|
| 2,864,516 | 12/1958 | Rogers | 414/564 X |
| 3,151,730 | 10/1964 | Bunten | 198/358 X |
| 3,416,679 | 12/1968 | Stobb | 214/8.5 |
| 3,486,604 | 12/1969 | Molins | 198/358 |
| 3,726,383 | 4/1973 | Bornfleth et al. | 198/358 X |
| 3,820,446 | 6/1974 | Granbom et al. | 92/88 |
| 3,826,487 | 7/1974 | Förster et al. | 271/263 |
| 4,127,198 | 11/1978 | Morini | 83/280 X |
| 4,328,609 | 5/1982 | Born | 29/564.3 |
| 4,348,801 | 9/1982 | Dumont et al. | 83/909 |

FOREIGN PATENT DOCUMENTS 18354 11/1957 German Democratic Rep. .

*Primary Examiner*—William R. Briggs
*Assistant Examiner*—Lawrence Meier
*Attorney, Agent, or Firm*—Arthur J. Hansmann

[57] ABSTRACT

A crane system sheet feeder method and apparatus employed for depositing collections of bundles of sheets in locations related to specific ones of sheet feeders, such that each collection of bundles can be utilized by an overhead crane to deliver the individual bundles to a specific one of the sheet feeders in accordance with the supply of sheets on that feeder. The bundles are initially bound, and the overhead crane has apparatus for removing the binding and removing the end boards from the bundles so that the bundles are deposited in the feeders free of any bindings.

8 Claims, 2 Drawing Figures

CRANE SYSTEM SHEET FEEDER METHOD AND APPARATUS

This invention relates to a crane system sheet method and apparatus, and, more particularly, it relates to a crane system for continuously supplying sheets to a sheet feeder which in turn is passing the sheets to a gatherer.

BACKGROUND OF THE INVENTION

The graphic arts industry is confronted with the problem of delivering printed sheets for signatures to a gatherer which collects the various sheets in the usual manner of forming a magazine, book, or the like. In that gathering function, the industry employs mechanically operated sheet feeders which pass the various sheets to a gatherer moving past each of several sheet feeders to pick up the sheet or signature from each feeder and thereby form the final signature or magazine or the like. In that process and with that apparatus, the mechanically operating sheet feeders must be supplied with bundles of sheets so that the process can be continuous and extensive and of a nonstop nature. In that regard, U.S. Pat. No. 3,416,679 shows a sheet feeder which receives a bundle of sheets and moves the bundle upwardly to where the top sheet is removed from the bundle and is placed onto the gatherer, and the process is repeated in a plurality of side-by-side sheet feeders and the top sheets are continuously removed from the bundles and placed onto the gatherers to form the final signatures or magazines or the like. An operator is required to supply a fresh bundle to each of the sheet feeders and that requires his constant attention and effort in order to keep the sheet feeder supplied with the bundles for feeding to the gatherer.

The present invention improves upon prior art by eliminating the manual labor required in supplying bundles to the sheet feeders, and it also insures that the sheet feeders will always be in full supply of their respective bundles, and the entire method and system of this invention is automated.

To accomplish the automation mentioned, an overhead crane is employed and it includes a type of fluid-actuated cylinder such as that shown in U.S. Pat. No. 3,820,446, for example.That is, the present invention utilizes a crane which responds to the condition of a minimal amount of signatures in any one signature feeder, and the crane then moves to a supply of bundles of sheets and picks up one of the bundles and deposits it on that particular sheet feeder requiring same. The crane thus utilizes a fluid-actuated cylinder which can compress the bundle at its opposite ends to pick up the bundle and transport the bundle and then lower the bundle into the sheet feeder, all in an automated arrangement.

Further, the present invention provides both a method and apparatus for removing the binding and the end boards from the bundle when the bundle is placed into the sheet feeder.

In the aforementioned arrangement with the present invention, there is no requirement for any manual labor, and the entire method and apparatus are fully automated, and thus the process of supplying the sheets is reliable and continuous in a high production achievement.

Another object and advantage of this invention is to provide a method and apparatus of sheet feeding and wherein valuable floor space is conserved in that only a minimal amount of floor space is required.

The aforementioned advantages and objectives are achieved in production where, for instance, a 300 page magazine is to be produced at the rate of 300 per minute. This requires that somewhere on the production line a bundle 40 inches long is required within every 18 seconds. The method and apparatus of this invention can automatically fulfill those high speed requirements without the need for manual labor and with only a minimum of apparatus and a minimum of valuable plant floor space being required.

DETAILED DESCRIPTION OF THE PREFERRED EMBODIMENT OF THE APPARATUS AND THE METHOD

Figure 1:
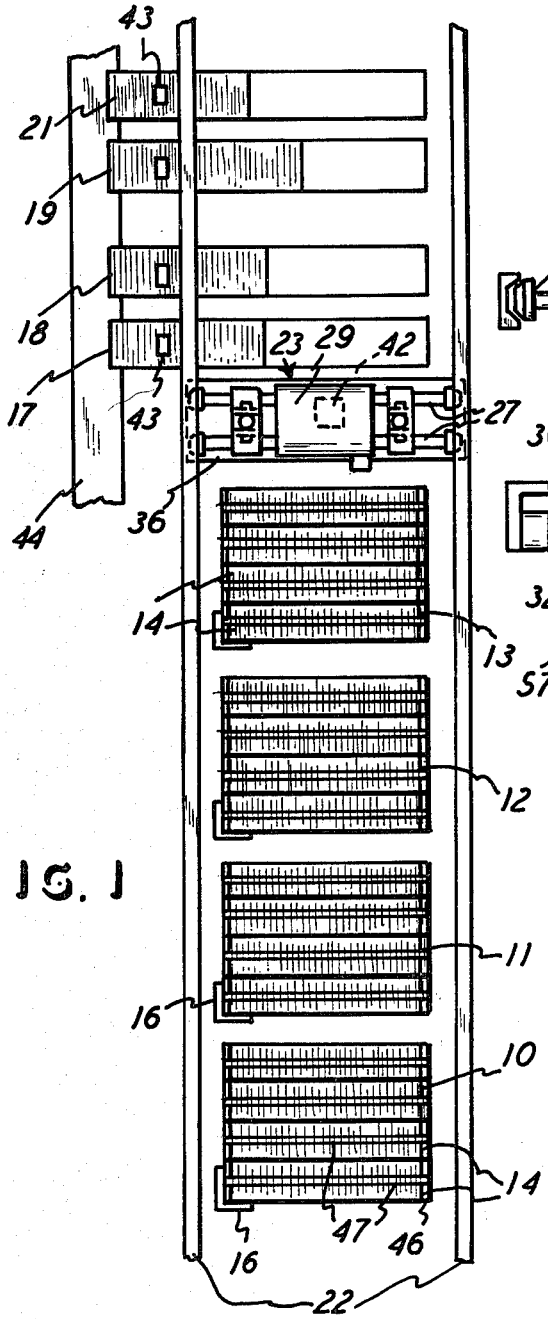
FIG. 1 is a top plan view of one embodiment of this invention.

The drawings, and the following description, in conjunction with the entire description, disclose the apparatus and the method of this invention. Further, to the extent necessary, reference is made to U.S. Pat. Nos. 3,416,679 and 3,820,446, and these two patents are incorporated into this description for purposes of describing the sheet feeder and the suggested embodiment of a fluid-actuated cylinder, respectively.

For example, four collections 10, 11, 12, and 13 of bundles of sheets or signatures 14 are disposed on the plant floor at specific locations identified by the shown angles 16. Located in positions related to those four collections of bundles of sheets are four sheet feeders 17, 18, 19, and 21. Thus, the location of the sheet feeder 17 relates to the location of the collection 10, and location of the sheet feeder 18 relates to the location of the collection 11, and likewise for the other two sheet feeders and two collections.

That is, there is a plurality of collections of bundles of sheets or signatures, and there is the same plurality of the sheet feeders, and each collection has a physical location related to a respective one of the sheet feeders, all for a purpose described later. Further, it will be seen and understood that the shown four sheet feeders are in a line, and, in the embodiment shown herein, the four collections are in the plane of the same line with the sheet feeders.

An overhead crane system is operative on the line mentioned, and it includes two spaced apart rails 22 which are suitably supported overhead in the plant, and a crane, generally designated 23 is suspended on the rails 22 and operates along the line mentioned to operate over the four collections as well as over the four sheet feeders, as disclosed. Thus, wheels 24 and 26 roll on the rails 22 and support two shafts 27 which in turn support two blocks 28 and a conventional motor housing and reel housing 29. The housing 29 encloses an electric motor (unshown) for instance, and energizing the motor will cause rotation of the shaft 27 and thus displacement of the entire crane 23 along its rails 22, in any manner understood by one skilled in the art.

Figure 2:
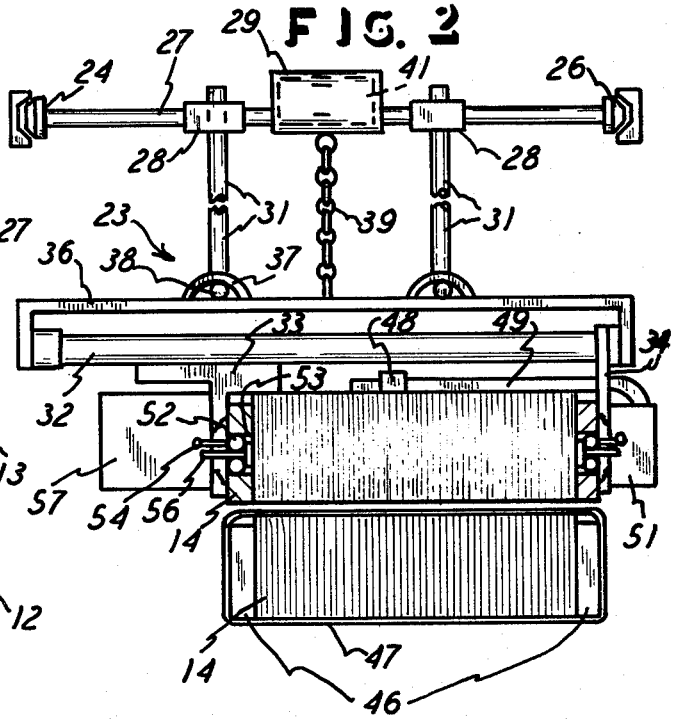
FIG. 2 is a front elevational view of the crane portion of this invention and showing it related to two bundles of sheets.

Two upright posts 31 are both slidable in the two blocks 28, and the posts upwardly support a conventional fluid-actuated cylinder assembly 32. The assembly 32 has conventional abutments 33 and 34 which are available for engaging the opposite ends of each bundle 14 and compressing the bundle along its longitudinal axis as shown in FIG. 2 with the upper bundle 14. That is, actuation of the assembly 32 will cause its abutments 33 and 34 to move toward each other to engage the opposite ends of the bundle 14 and thereby compress the bundle and be able to pick up the bundle from the four bundle collections shown and described.

A support bracket 36 has connectors 37 affixed thereto, and the lower ends of each of the posts 31 engage the connectors 37, such as by means of the T-shaped ends 38 which extend into the two spaced-apart connectors 37, as shown in FIGS. 1 and 2. Thus, the posts 31 guide the cylinder assembly 32 in its elevating motions up and down for the pick up and deposit of the bundle 14, as described herein.

A flexible connector 39 extends from the reel housing 29 and connects with the brackets 36, such that, upon operation of the electric motor within the housing 29, a reel designated 41 will rotate and thus extend or withdraw the chain or flexible connector 39 to lower and raise the cylinder assembly 32.

In operation, the crane 23 is positioned over one of the four collections of bundles and the electric motor or the like in the housing 29 is operated to lower the crane 23 through extension of the support chain 39. The cylinder abutments 33 and 34 flank a particular bundle 14 whereupon the cylinder assembly 32 is contracted to clamp that particular bundle 14 and thus hold it, as shown in FIG. 2. The electric motor or the like in the housing 29 is then reversed so that the chain 39 is wound up on its reel 41 and thus the bracket 36 and the attached cylinder assembly 32, along with the bundle 14, are all raised upwardly and overhead so that the bundle 14 is picked up off its particular collection of bundles. The particular but conventional motor within the housing 29 is then operated to rotate the shafts 27 and thereby cause the crane 23 to move along its support tracks 22 to a position above the particular one of the four sheet feeders shown. Again, the motor controlling the reel 41 is operated to lower the cylinder assembly 32 and thus position the bundle 14 on the particular sheet feeder and again the cylinder assembly 32 is released relative to the bundle 14 which is then positioned on the sheet feeder. The fact that the sheet feeder may be at an upwardly inclined angle from right to left, as viewed in FIG. 1, and that is normal, the connector chain 39 can accomodate that angulation of placing the bundle 14 onto the sheet feeder, and also the posts and 31 and the connections 37 and 38 can accomodate the angulation described so that the bundle 14 is properly placed into the sheet feeder when additional sheets are needed in that particular feeder. One skilled in the art will understand that there are conventional motors, such as electric motors, within the housing 29 for the purpose of raising and lowering the cylinder assembly 32 and another electric motor for the purpose of rotating the shafts 27, as described. Also, FIG. 1 indicates an electric switch 42 which is available for control of either or both of the two electric motors mentioned.

Each of the four sheet feeders has a sensor 43 adjacent thereto for detecting the presence of sheets in the feeder and the sensor will actually detect when a minimum amount of sheets or signatures is in that particular feeder. That sensor is preferably a photo electric sensor and it is electrically connected, by any conventional arrangement well understood by one skilled in the art, to the motor in the housing 29 which displaces the crane 23 to its positions relative to the particular collection of bundles and relative to the particular one of the four feeders shown. That is, when a particular sensor 43 detects a need for additional sheets in its particular feeder, then the crane motor is energized to move to the particular one of the four collections 10, 11, 12, or 13, and to then pick up one of the bundles 14 from that collection and to deliver that bundle to the particular one of the four sheet feeders 17, 18, 19, or 21, depending upon which sheet feeder required the additional supply from its particular collection, it being understood that each collection of sheets contains sheets different from the other collections and each sheet feeder thus handles only its particular and unique type of sheet or signature.

In this operation, it will also be seen and understood that the four sheet feeders shown to supply a gatherer 44 which is shown FIG. 1 and which will be well understood by anyone skilled in the art, and the gatherer collects the sheets from each of the several feeders and forms the additional signature or magazine or the like.

For further background to this invention, and also for further description by way of incorporation, U.S. Pat. No. 3,826,487, particularly in FIGS. 5 and 6 in conjunction with FIG. 1, shows the use of a photo electric system for controlling a machine or motor, similar to the photo electric member 43 and the motor for the crane in the present invention. Thus, one skilled in the graphic arts is already aware of the use of photo electric cells for signaling to a remote motor. Further, German Democratic Republic Pat. No. 18,354 shows the use of a cable and basket type of pick-up device for bundles, but that is distinguishable from the present invention which utilizes an overhead crane functioning between related locations of specific collections of bundles and specific sheet feeders, as described herein.

FIG. 2 shows a bundle 14 in the lowermost position, and that may be on the top of one of four collections described, and it has the usual end boards 46 and the binding or strap 47 extending therearound for containing the entire bundle, all in the conventional arrangement. Each bundle in each of the collections is formed as shown by the bundle just described, and the bundle can remain in that condition until it is positioned relative to the sheet feeder at which time the strap 47 is removed and the end boards 46 are removed. To accomplish that, the crane 23 is shown to include a strap cutter 48 and a feed tube 49 and a container 51, all suitably mounted on the cylinder assembly 32. Thus, the cutter 48 will engage and cut the strap 47 and feed it into the container 51, after the bundle is gripped by the assembly 32. Such strap cutter and associated mechanism is of a nature which will be readily understood by anyone skilled in the art.

Further, the cylinder assembly 32 contains a bladder 52 which is disposed within an opening 53 in each end board 46. An air line 54 extends into the bladder 52 to inflate the bladder and thus engage the end board at its opening 53 and thereby, through a retraction T-pin 56, for instance, the two boards 46 can be withdrawn from the sheets and retained by the assembly 32 until they are released elsewhere. That is, the T-pins 56 are suitably actuated, such as through air piston power which is available to the bladder 52, and thus the pins 56 withdraw the boards 46 when the bladders 52 are inflated and in tight engagement with the boards 46. That is, the piston abutments 33 and 34 can be connected with the T-pins 56 so that retraction of the abutments 33 and 34 will retract the T-pins and the boards 46 when the bundle is released in its specific sheet feeder 17, 18, 19, or 21.

Further, a microprocessor (not shown) can be utilized for coordinating the sensing or signaling created by the photo electric member 43 or the like, and that processor will govern the action of the crane motor for displacement of the crane by driving its shafts 27 and by raising and lowering the assembly 32, with all of the actions being such that the appropriate unique bundle of sheets will be taken from a specific one of the collections and deposited on a specific one of the sheet feeders which requires that particular bundle of sheets. Also, a conventional actuator 57 is shown mounted on the assembly 32, and its includes standard mechanism for powering the retractors 56 in retrieving the boards 46.

What is claimed is:

1. A method for continuously loading bundles of bound sheets, bound with binding, into a plurality of sheet feeders by means of an overhead crane, comprising the steps of positioning a plurality of discrete collections of the bundles of bound sheets in positions relative to respective ones of the sheet feeders, each collection of bundles being sheets with printings thereon varying from collection to collection, electronically sensing the quantity of the sheets in each of the sheet feeders and generating a signal relative to each respective sheet feeder and in response to a minimum supply of the sheets in each respective sheet feeder, actuating the overhead crane by virtue of the signal and operating the crane to move to one of the collections of bundles and remove one of those bundles from said one collection, and actuating the overhead crane by virtue of the signal to deposit said one bundle onto only the one of the sheet feeders which is related to said one collection of bundles.

2. The method for continuously loading bundles of bound sheets into a plurality of sheet feeders, as claimed in claim 1, including the step of removing the binding from each of the bundles after the bundle is deposited onto the sheet feeder.

3. The method for continuously loading bundles of bound sheets into a plurality of sheet feeders, as claimed in claim 1 or 2, including the step of compressing the removed bundle together from its two opposite ends, and holding the bundle compressed and then removing the binding from the bundle .

4. The method for continuously loading bundles of bound sheets into a plurality of sheet feeders, as claimed in claim 1, including the step of defining a separate location for each of the discrete collections of bundles, and supplying additional bundles to each of the collections in accordance with the quantity of bundles in each of the collections.

5. The method for continuously loading bundles of bound sheets into a plurality of sheet feeders, as claimed in claim 1 or 4, including the step of positioning the collection of bundles so that they are in a straight line with the sheet feeders.

6. Sheet feeder crane system apparatus comprising a plurality of sheet feeders disposed in positions related to each other, a plurality of collections of bound bundles of sheets disposed in positions with each of said collections related to a respective one of said sheet feeders, each of said collections of bundles being of sheets with printings thereon varying from collection to collection, an overhead crane track disposed in line with and extending directly vertically above said sheet feeders and said collections, a crane movably mounted on said crane track and including powering means for lowering and raising said crane to pick up said bundles and deposit said bundles onto said sheet feeders, and a signal means associated with each of said sheet feeders for detecting the quantity of sheets in each of said sheet feeders, and means operatively associated with said powering means and said signal means for effecting movement of said crane to deliver bundles from a respective said collection and to only a respective said sheet feeder.

7. Sheet feeder crane system apparatus as claimed in claim 6, wherein said sheet feeders and said collections are all disposed in one line, and said crane track extends in the plane of said one line.

8. Sheet feeder crane system apparatus as claimed in claim 6 or 7, including means on said crane for removing the binding from said bundles after said bundles are deposited onto said sheet feeders.

* * * * *